US009101793B1

(12) United States Patent
Kervin

(10) Patent No.: US 9,101,793 B1
(45) Date of Patent: Aug. 11, 2015

(54) SOFT SHOULDER WEIGHT AND PHYSICAL THERAPY DEVICE

(71) Applicant: Bruce Kervin, Hot Springs, AR (US)

(72) Inventor: Bruce Kervin, Hot Springs, AR (US)

( * ) Notice: Subject to any disclaimer, the term of this patent is extended or adjusted under 35 U.S.C. 154(b) by 87 days.

(21) Appl. No.: 13/843,281

(22) Filed: Mar. 15, 2013

Related U.S. Application Data

(60) Provisional application No. 61/684,724, filed on Aug. 18, 2012.

(51) Int. Cl.
*A63B 21/065* (2006.01)
*A63B 21/06* (2006.01)
*A63B 21/00* (2006.01)

(52) U.S. Cl.
CPC ..... *A63B 21/065* (2013.01); *A63B 21/06* (2013.01); *A63B 21/1411* (2013.01); *A63B 21/0603* (2013.01)

(58) Field of Classification Search
CPC ..... A63B 21/065; A63B 21/1411; A63B 21/1415; A63B 2208/0223
USPC ..... 482/43, 69, 78, 93, 105, 124, 148; 224/259, 260, 262, 264, 578, 579, 627, 224/637, 643, 647; 2/102, 468, 913, 44, 45, 2/267, 268, 310, 459–462; 119/770
See application file for complete search history.

(56) References Cited

U.S. PATENT DOCUMENTS 2,986,738 A * 6/1961 Zubiate ..... 2/461
4,098,404 A * 7/1978 Markert ..... 206/525
4,139,920 A * 2/1979 Evans ..... 5/655.4
4,394,012 A * 7/1983 Egbert et al. ..... 482/105
4,568,442 A 2/1986 Goldsmith
4,602,387 A 7/1986 Zakrzewski
4,914,837 A * 4/1990 Rieffel ..... 36/88
5,080,191 A * 1/1992 Sanchez ..... 182/3
D342,108 S 12/1993 Leibowitz
5,319,806 A * 6/1994 Hermann et al. ..... 2/461
5,361,957 A * 11/1994 Weintraub ..... 224/264
D360,440 S 7/1995 Banks et al.
5,540,364 A * 7/1996 Krieger et al. ..... 224/153
5,683,336 A * 11/1997 Pape ..... 482/124
5,961,014 A * 10/1999 Knerr ..... 224/259
6,081,924 A * 7/2000 Ott ..... 2/102
6,149,557 A 11/2000 Williams et al.
6,361,478 B1 * 3/2002 Giancaspro ..... 482/69
D470,979 S 2/2003 Banton et al.
6,554,752 B2 * 4/2003 Cook ..... 482/105
D475,813 S 6/2003 Moreno
6,814,270 B2 * 11/2004 Mason ..... 224/587
6,837,832 B2 1/2005 Hanners et al.
7,017,525 B2 * 3/2006 Leach ..... 119/770
7,806,816 B2 * 10/2010 Erez ..... 482/148
7,874,970 B2 * 1/2011 Glisan ..... 482/124
8,147,252 B1 * 4/2012 Stanford et al. ..... 434/255

(Continued)

*Primary Examiner* — Loan H Thanh
*Assistant Examiner* — Gregory Winter
(74) *Attorney, Agent, or Firm* — Rashauna A. Norment

(57) ABSTRACT

A soft shoulder weight device for use during vigorous or robust physical activity is a harness having two shoulder straps, with each strap supporting a pocket for holding a weight member, a plurality of quick-release connecting members, two underarm straps, and a back strap. The back strap connects to the shoulder straps and also provides an adjustable connection point for the underarm straps. The weight members are selectively interchangeable and may have masses ranging from approximately 5 pounds to 60 pounds.

19 Claims, 16 Drawing Sheets

(56) References Cited

U.S. PATENT DOCUMENTS 8,418,899 B1 * 4/2013 Stamps ..... 224/251
8,819,984 B2 * 9/2014 Borkowski et al. ..... 42/94
2007/0090143 A1 * 4/2007 Clayton et al. ..... 224/637

* cited by examiner

SOFT SHOULDER WEIGHT AND PHYSICAL THERAPY DEVICE

CROSS-REFERENCE TO RELATED APPLICATIONS

This application is a nonprovisional application of U.S. Provisional Patent Application No. 61/684,724, filed on Aug. 1, 2012, and is incorporated by reference.

FEDERALLY SPONSORED RESEARCH AND DEVELOPMENT

Not applicable.

BACKGROUND OF THE INVENTION

1. Field of the Invention

The Invention generally relates to a soft shoulder weight device for use in exercise and physical therapy programs. More particularly, the invention is an adjustable soft shoulder weight device having interchangeable moderate to heavy weight members attached over the user's shoulders, with an adjustable neck strap for preventing the shoulder straps from falling off the user's shoulders during vigorous or robust physical activity.

2. Description of Arguably Related Art Including Information Disclosed 37 CFR 1.97 and 1.98.

Some exercise programs, fitness training regimes, and physical therapy programs use various weights and resistance-weight devices. Often, one or more weights or resistance-weight devices are attached to a person's body. For example, some of these devices are attached to the person's torso, and/or to one or more extremities. Examples of resistance-weight devices include without limitation, wrist weights, ankle weights, weighted waist belts, and weighted vests and jackets. These weights may have different masses, and may be attached to or inserted into different harnesses, halters, or vests.

The shoulders are one of the body's main strength and balance centers. Very few devices have effectively attached weights directly over the shoulder(s). Previous attempts have been unable to provide a flexible, adjustable, soft shoulder weight device that accommodates selectively interchanging moderate to heavy weights for placement over the shoulders for use in vigorous or robust activities. Examples of vigorous or robust activities include without limitation, walking, running, jumping, calisthenics, summersaults, cartwheels, and aerobics. Other activities include without limitation, squats, lunges, stretching, stand-ups, sit-downs, and toe raises.

Market research shows an extremely high consumer interest in the concept of resistance-weighted fitness aids but a low desirability-factor after viewing the shoulder-related arguably related art. These attempts are unsuitable to accomplish the task because each fails to adequately secure the weights across the shoulders to allow for any sort of robust activity. Engaging in such activity is required to achieve the intended strength, stamina, and/or therapeutic benefits. Previous shoulder weight devices also do not have the ability to increase/decrease the poundage or mass of the weights when desired. This may result in low consumer appeal and lack of market acceptance.

U.S. Pat. No. 6,837,832 issued to Hanners et al. discloses a shoulder weight halter and corresponding weight(s). The invention includes two shoulder straps, a chest strap, right and left support straps, and a weight that attaches to one of the shoulder straps. The chest strap is adjustable with a double-D ring with buckle inserts, which lock into a quick release buckle clasp. A butterfly strap provides positional stability to the upper part of the shoulder straps and about the torso. When weights are attached to the shoulder straps, the weights might pull the straps from the user's shoulders. The butterfly strap may be positioned in the back of the halter over user's shoulder blades. The weights are filled with pellet weights. A disadvantage of the invention disclosed in the Hanners Patent is that the halter is cumbersome to strap into and to wear during physical activity. It does not disclose the ability of the user to engage in vigorous or robust activity because it appears that these weights are not secured enough to the halter to prevent them from repositioning during the physical activities.

U.S. Pat. No. 6,149,557 issued to Williams et al. discloses a soft shoulder weight device comprising a weight bag having a first and second end resting on the user's chest, the bag having a flexible covering material sewn and shaped to fit across the shoulders and filled with ballast which migrates within the bag to accommodate the physiological make-up of the user. Closers, such as zippers, can be used to provide access to the ballast for adjustment of the total amount contained within the weight bag. It also discloses that pockets may be sewn onto the device to accommodate the addition of solid weight elements, without adding additional length to the design.

U.S. Pat. Nos. D360,440 issued to Banks et al., D470,979 issued to Banton et al., D475,813 issued to Moreno, and D342,108 issued to Leibowtiz disclose shoulder harnesses, but do not expressly disclose adding weights.

Thus, there is a need for a hands-free, compact, soft shoulder weight device that allows the user to selectively interchange a variety of weights from moderate to heavy per shoulder, and to allow the user to wear the device during vigorous or robust physical activities. There is also a need for a soft shoulder weight device that is easy to assemble and wear.

None of these expressly disclose, teach or suggest a flexible soft shoulder weight device for use in vigorous or robust activity, with the soft shoulder weight device comprising a harness or halter having two shoulder straps, each with pockets for holding a weight member, two adjustable underarm straps having quick-release connecting members for connecting the harness over the body, an adjustable neck strap for maintaining the position of the shoulder straps, a chest strap or quick-release connector, and a plurality of selectively interchangeable moderate to heavy weight members being insertable into each pocket and secured with at least one pocket flap.

BRIEF SUMMARY OF THE INVENTION

The Invention is generally a soft shoulder weight device comprising (including or having) a harness (or halter) having two shoulder straps, with each shoulder strap having a base supporting a pocket for holding a weight member, and a plurality of quick-release connecting members so the user can wear the device. The harness may be a unitary device having a chest strap connecting member (or connector), and an adjustable neck strap with connecting member. Alternatively, the harness may have multiple removably adjustable components, preferably a chest connecting member, an adjustable neck strap having a connecting member; a pair of underarm straps each having a strap-length extender, a connecting member, and a strap-to-base attachment member; and a horizontal base (or back) strap below the rear ends of the shoulder straps having a base-to-base attachment member and two base-to-strap attachment members. The weight members may be quickly and easily interchanged and may be selected from a varying range of masses to customize the total weight of the harness. Alternatively, the harness may be selected based on the predetermined total mass of the weight members permanently integrated into the shoulder straps.

The harness may be worn over a variety of body shapes and sizes, and may be adjusted to fit the user by adjusting the adjustable, horizontal underarm straps. The mass of the weight members may be selectively chosen and quickly interchanged by the user. One or more of the components, such as the horizontal base (or back) strap, underarm straps, and weight members, may be permanently attached or otherwise affixed to the harness. The user may engage in hands-free, vigorous or robust activities while wearing the harness, and does not need to worry that the weighted shoulder straps will fall off the shoulders.

It is an object of the present invention to provide an improved soft shoulder weight device that is easy to assemble and use during vigorous and/or robust activity.

It is an object of the present invention to provide a soft shoulder weight device that has a plurality of interchangeable weight members having different or varying masses.

It is an object of the present invention to provide a soft shoulder weight device that is adjustable to accommodate different body sizes and shapes.

It is an object of the present invention to provide a soft shoulder weight device that is worn during exercise, fitness, or physical therapy programs.

It is an object of the present invention to provide a soft shoulder weight device that has a quick-release connector for easy access to the weight members.

Other objects and advantages of the invention will become more apparent from the summary and detailed description.

Figure 1:
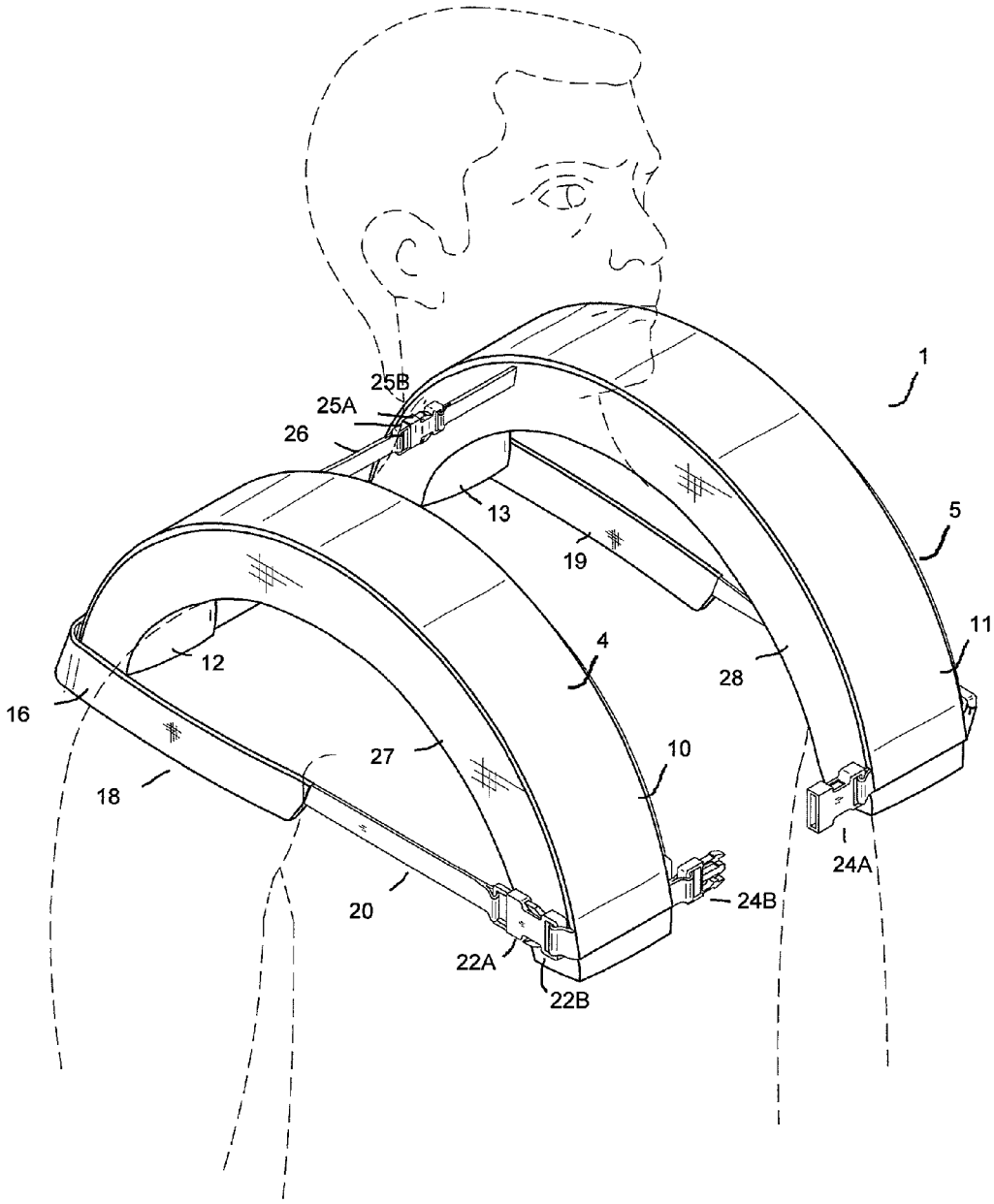
FIG. 1 is a perspective view of the soft shoulder weight device, shown in use and with the chest strap connectors shown in an open position, and the neck strap connectors and the underarm strap connectors shown in a closed position.
Figure 2:
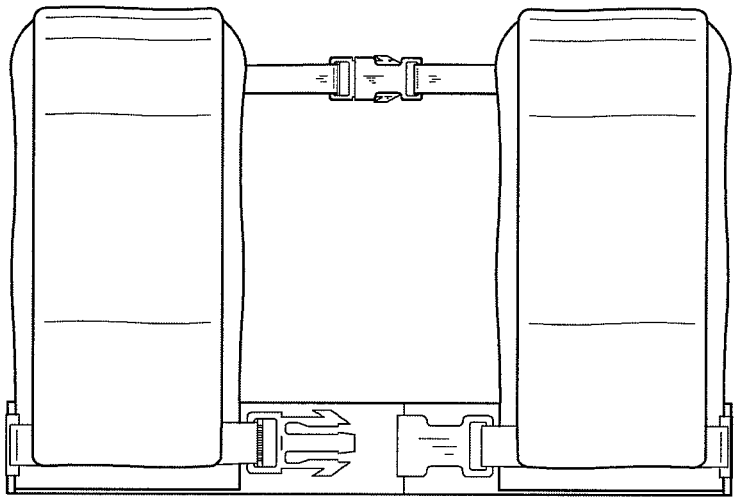
FIG. 2 is a front elevation view of FIG. 1 thereof.
Figure 3:
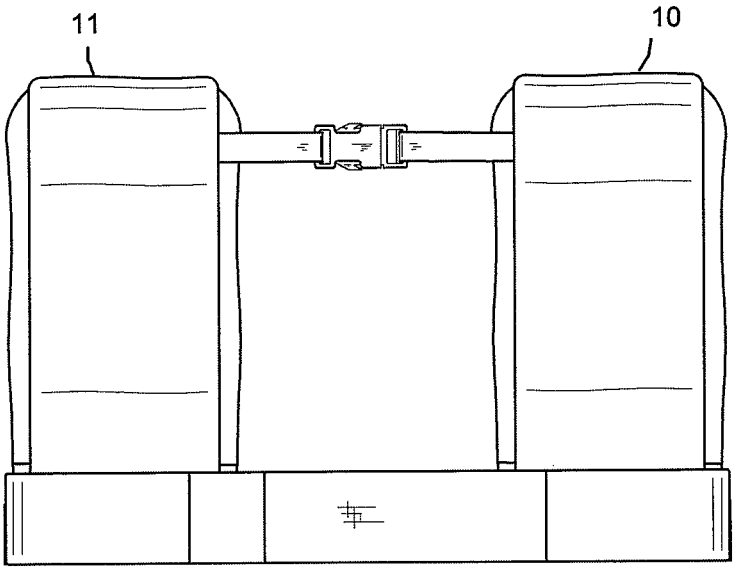
FIG. 3 is a rear elevation view of FIG. 1 thereof.
Figure 4:
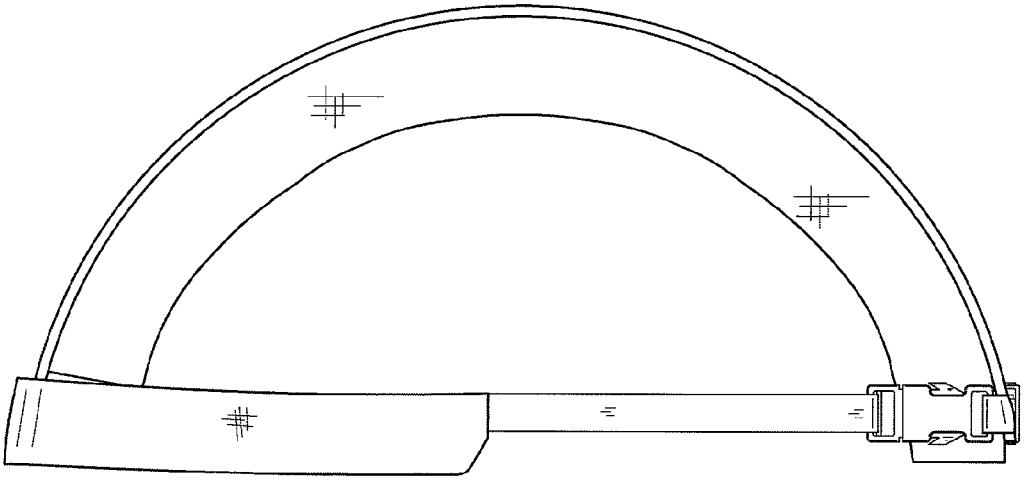
FIG. 4 is a left side elevation view of FIG. 1 thereof, the right side elevation view is a mirror image of the left side elevation view.
Figure 5:
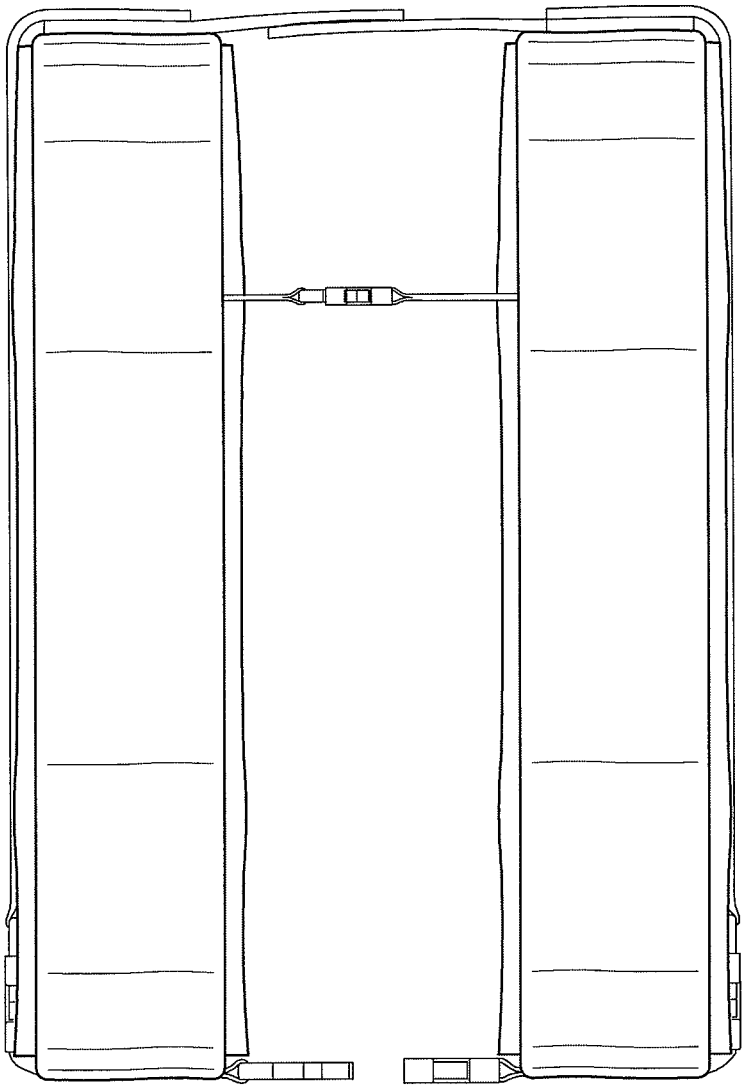
FIG. 5 is a top plan view of FIG. 1 thereof.
Figure 6:
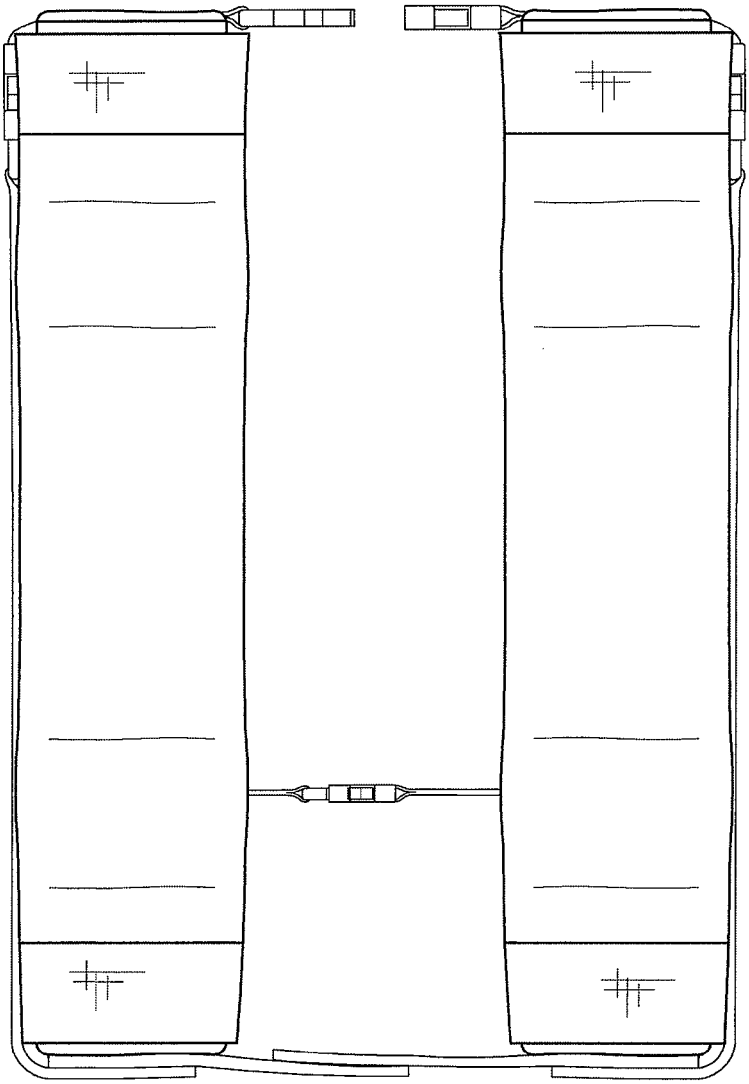
FIG. 6 is a bottom plan view of FIG. 1 thereof.
Figure 7:
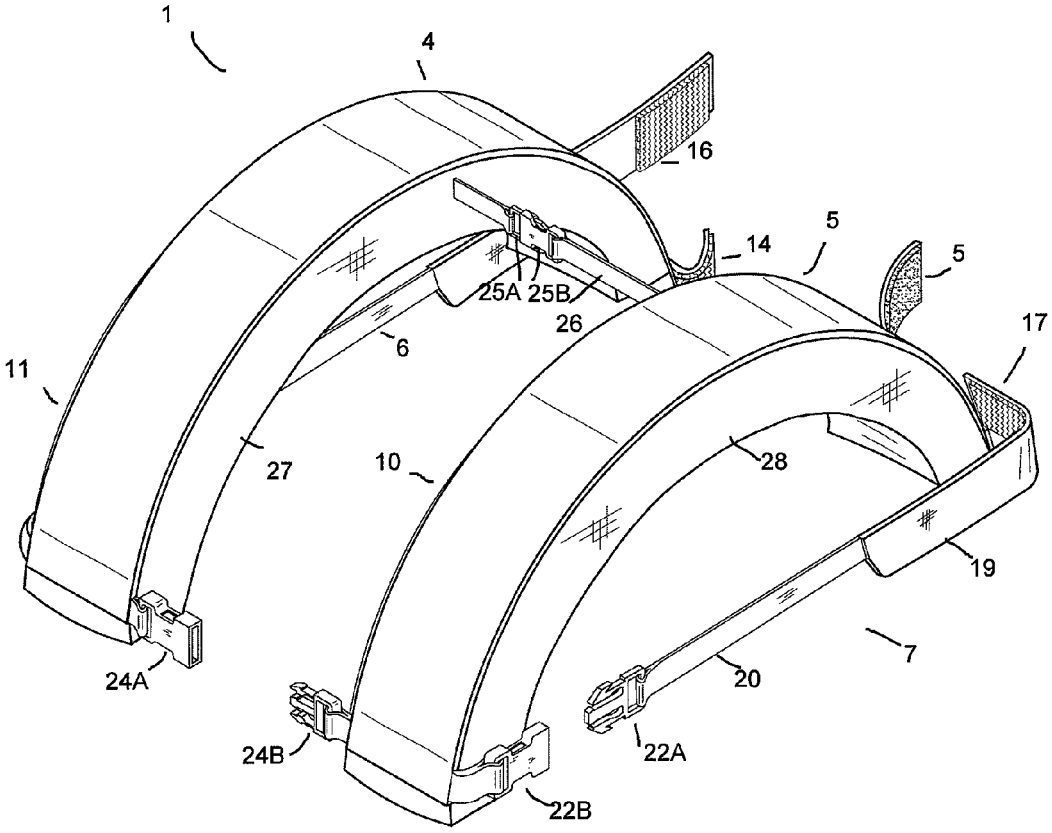
FIG. 7 is another perspective view of FIG. 1 thereof, with all of the connectors and attachment members shown in an open position, except for the neck strap connector which is shown in a closed position.

The broken lines are for illustrative purposes only, and do not form part of the claimed invention. The zig-zag lines represent stitching.

DETAILED DESCRIPTION OF THE INVENTION

For the sake of simplicity and to give the claims of this patent application the broadest interpretation and construction possible, the conjunctive "and" may also be taken to include the disjunctive "or," and vice versa, whenever necessary to give the claims of this patent application the broadest interpretation and construction possible. Likewise, when the plural form is used, it may be taken to include the singular form, and vice versa.

The invention disclosed herein is not limited by construction materials to the extent that such materials satisfy the structural and/or functional requirements. For example, any material may be used so long as it satisfies the function for which it is being used.

Although the present invention has several embodiments, one preferred embodiment of the invention is a soft shoulder weight device comprising (including or having):

a. two shoulder straps, each of the shoulder straps comprising a base having a plurality of quick-release connecting members, a horizontal strap below the shoulder strap, and a pocket for receiving a weight member, with the pocket affixed to the base;

b. two adjustable underarm straps, each of a first and a second underarm straps comprising an underarm attachment member, a strap-length extender for extending the length of the underarm strap around the width of the body, and a first and a second quick-release connecting member for connecting one end of the strap-length extender to the front outside corner of the shoulder strap;

c. an adjustable neck strap having a strap and a third quick-release connecting member connected to the inside of each lateral side of the shoulder straps for maintaining the position of the shoulder straps on the shoulders;

d. a chest strap having a fourth quick-release connecting member for connecting the front of the shoulder straps together near the front of the body; and e. a plurality of selectively interchangeable weight members, a single weight member insertable into each of the pockets.

Another preferred embodiment of the invention is a soft shoulder weight device having moderate to heavy weight members for use during vigorous or robust physical activity, the soft shoulder weight device comprising:

1. a left shoulder strap having an elongated base panel for positioning over the shoulder; a horizontal base (or back) strap for abutting against the back, the horizontal base strap having a top surface comprising a first removably adhering portion and a second non-adhering portion, and a bottom surface comprising a first non-adhering portion and a second adhering portion; a first mating end of a chest strap quick-release connecting member near the front lateral inside of the base panel, a first mating end of a neck strap quick-release connecting member near the rearward center lateral inside of the base panel, and a first mating end of an underarm strap quick-release connecting member near the front lateral outside of the base panel;

2. a right shoulder strap having an elongated base panel for positioning over the shoulder; a horizontal base strap for abutting against the back, the horizontal base strap having a top surface comprising a first and a second adhering portion, with the second adhering portion of the bottom surface of the first shoulder strap adjustably overlapping and adhering to the adhering portion of the top surface of the second shoulder strap, forming a horizontal back strap; a second mating end of the chest strap quick-release connecting member near the front lateral inside of the base panel for connecting with the corresponding first mating end, the neck strap further including a second mating end of a neck strap quick-release connecting member near the rearward center lateral inside of the base panel for connecting with the corresponding first mating end, and a second mating end of the underarm quick-release connecting member near the front outside lateral of the base panel for connecting with the underarm first mating end;

3. each of the base panels comprising a pocket affixed to the base panel, the pocket having two opening flaps for enclosing a weight member;

4. two underarm straps, each of the underarm straps having an adhering bottom surface for adjustably adhering to the top adhering surface of each base panel, a strap extender for extending the width of the device, a stretchable material for extending the length of the underarm strap, and a second mating end attached to the strap extender ad for connecting with the corresponding first mating end near the front outside lateral side of the base panel; and 5. two of a plurality of interchangeable weight members having masses approximately ranging from five to sixty pounds, with a first weight member insertable into the pocket of the left shoulder strap and a second weight member insertable into the pocket of the right shoulder strap.

Yet another embodiment of the invention is a soft shoulder weight device having moderate to heavy weight members for use in vigorous or robust physical activity, the soft shoulder weight device comprising: a harness having two shoulder straps, each of the straps having a front quick-release connecting member for connecting the shoulder straps at the chest, an adjustable rear neck strap having a quick-release connecting member for maintaining the position of the shoulder straps, and a pocket enclosing a weight member; a horizontal back strap below the ends of the shoulder straps, the horizontal back (or base) strap comprising two stretchable materials, each attached near the outside front lateral side of each of the shoulder strap for accommodating the width of a user's chest.

Each shoulder strap member includes a base (or base panel), a pocket for holding the weight member insertable therein and having a pair of flaps for keeping the weight member inside the pocket, a plurality of quick-release connecting members (or connectors), and a horizontal base strap below the rear ends of the shoulder strap.

The harness 1 allows the user to add or interchange a weight member 8, 9 to each shoulder strap 4, 5, with each weight member selected from a plurality of weight members having different or varying masses. The device provides a customized resistance-weighted harness 1 that is firmly and securely held in place over the shoulders in a balanced unobstructive and non-obtrusive manner. The user will have full and complete range of motion and use of the arms, head and neck while wearing the harness 1.

The harness 1 may be fabricated from materials selected from the group consisting of lightweight canvass, fabrics, cloth, plastics, rubbers, and combinations thereof. During manufacture, the harness 1 may be machine-sewn or stitched. The harness 1 is a soft, durable, lightweight material, preferably a lightweight canvass fabric. All sewing is according to industry-standard sewing practices. Other examples include without limitation, machine-sewn or stitched, hand sewing, staples, adhesives, crimps, and rivets. The type of fabric print and color may be selected according to the user's preference and style. The size of the harness 1 is available in a variety of sizes to accommodate different user's body types, shapes, and sizes. As shown in Figures, the harness 1 includes at least three adjustment points to accommodate a variety of torso thicknesses. These include the base adjustment area, and two side underarm adjustment areas.

Each shoulder strap member 4, 5 includes a base 10, 11, a pocket 27, 28, a base-to-strap attachment member 12, 13, and a horizontal shoulder-to-shoulder (or base-to-base) attachment member 14, 15. Each shoulder strap 4, 5 further includes four sets of quick-release connectors, a shown in FIGS. 1, 7, 11 and 12.

The reference numbers shown in FIGS. 1, 7, 8, 12-16 are applicable to each relevant embodiment shown in the remaining figures. As shown in the figures, each base 10, 11 is essentially a double layer of fabric having a thin facing material. Each base has a corresponding mating end of a chest strap connector 24A, 24B that is attached to the forward inside of the base panel 10, 11 for connecting to the opposite mating end of the chest strap connecting member at the opposite base. For example, chest connector 24B from base 10 connects with the mating chest connector 24A from base 11. The mating end 22B, 23B of the underarm connector is attached to the forward outside of the base panel 10, 11. Underarm strap connectors 22B, 23B connect to the underarm strap connectors 22A, 23A respectively. The mating end of the neck strap connector 25B is attached near the rearward center of the base panel 10, 11. The attachment member portion of the horizontal base strap is divided into two sections for the base-to-strap attachment members 12, 13 and the base-to-base strap 14, 15. The inside facing of one base-to-base strap section 14 includes hook or loop which mates with the outside facing of the second to base-to-base attachment section 15 also having a corresponding hook or loop. When assembling, the mating ends of the base-to-base attachment members (or sections) 14, 15 overlap. This adjustment keeps the shoulder strap members in a vertical position while accommodating different shoulder and neck widths. Alternatively, the base-to-base straps are permanently affixed, rather than adjustably removable. Although hooks and loops are preferred, any other compatible means for adjusting and adhering the base-to-base straps (also called back-to-back straps) and strap-to-base (also called strap-to-back) attachment sections (or members) may be used. The underarm strap-to-base attachment members 16, 17 overlap with the respective base-to-strap attachment members 12, 13. Alternatively, the mating ends of one or more of the attachment members may be reversed.

Figure 8:
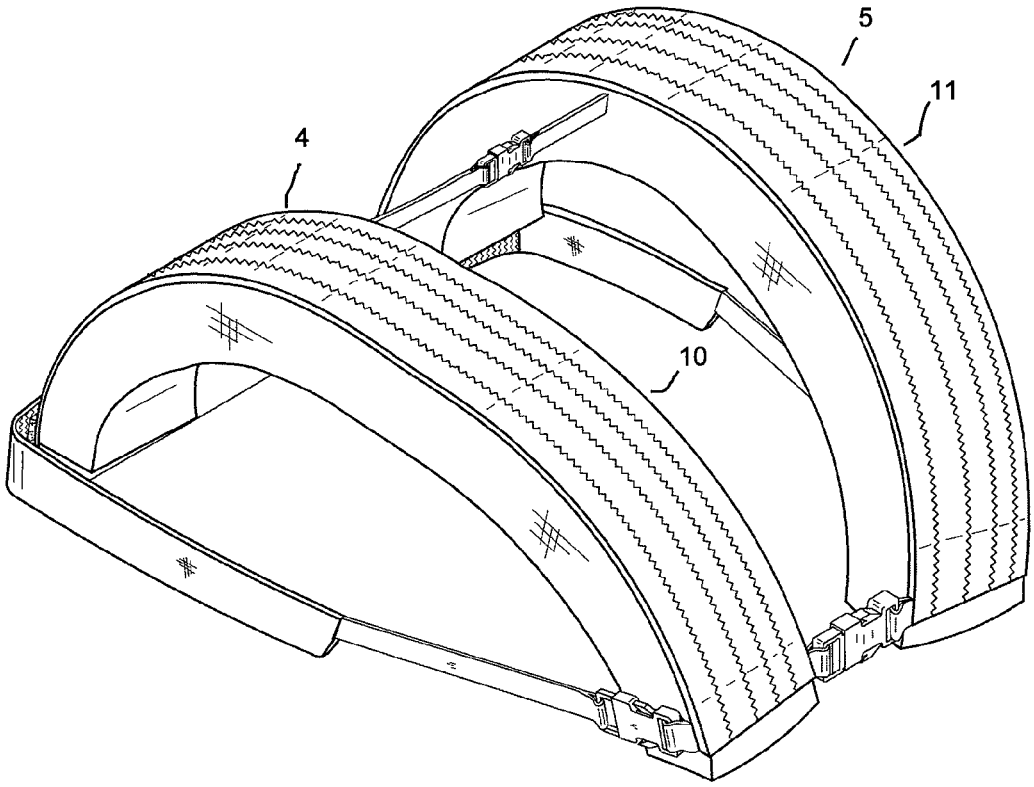
FIG. 8 is an alternative embodiment of FIG. 1 thereof, showing columns of zig-zag stitching, and the front shoulder straps forming a "V" near the chest strap connector.

In one embodiment shown in FIG. 8, multiple columns of zigzag stitching along the base panel 10, 11 help to maintain the shape of the shoulder strap 4, 5 during use. In one embodiment for the five to eighteen pound weight class, the length of the base panel is approximately 17 inches long, 3 inches wide, with a ½ inch double thick hem around the perimeter of the base panel. The attachment member section, or horizontal base strap, is approximately 9 inches long and 2 inches wide. More particularly, the underarm attachment section is approximately 4 inches long and 2 inches wide, and the strap-to-strap attachment section is approximately 5 inches long and 2 inches wide. The stretchable material, preferably an elastic material, is 4 inches long.

Figure 14:
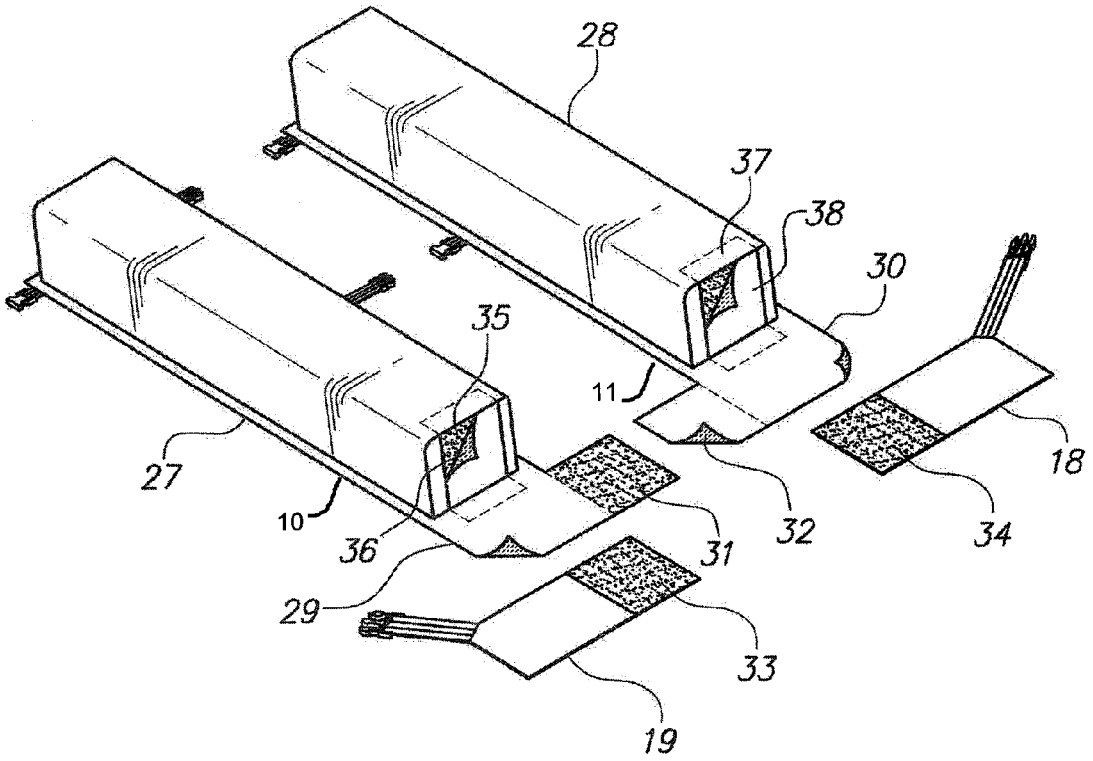
FIG. 14 is an exploded perspective view of FIG. 9 thereof, with the pockets attached to the base panels, with the underarm straps disassembled for clarity.
Figure 15:
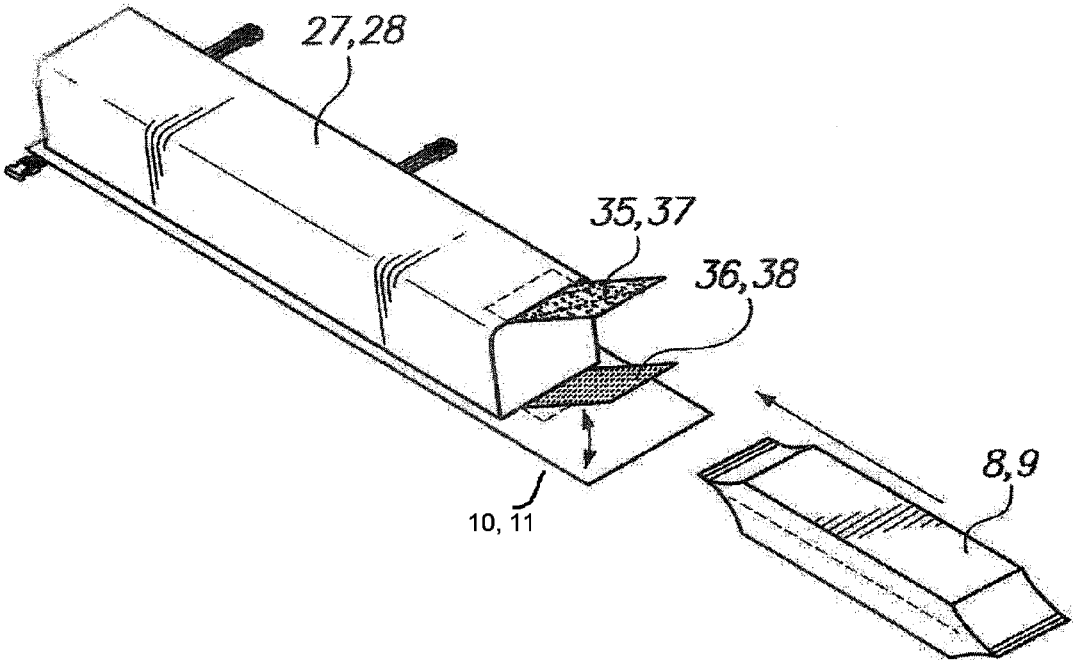
FIG. 15 is an exploded view of FIG. 9 thereof, with the pocket attached to the base panel, with the pocket flaps opened to show closure movement, and an insertable weight member.
Figure 16:
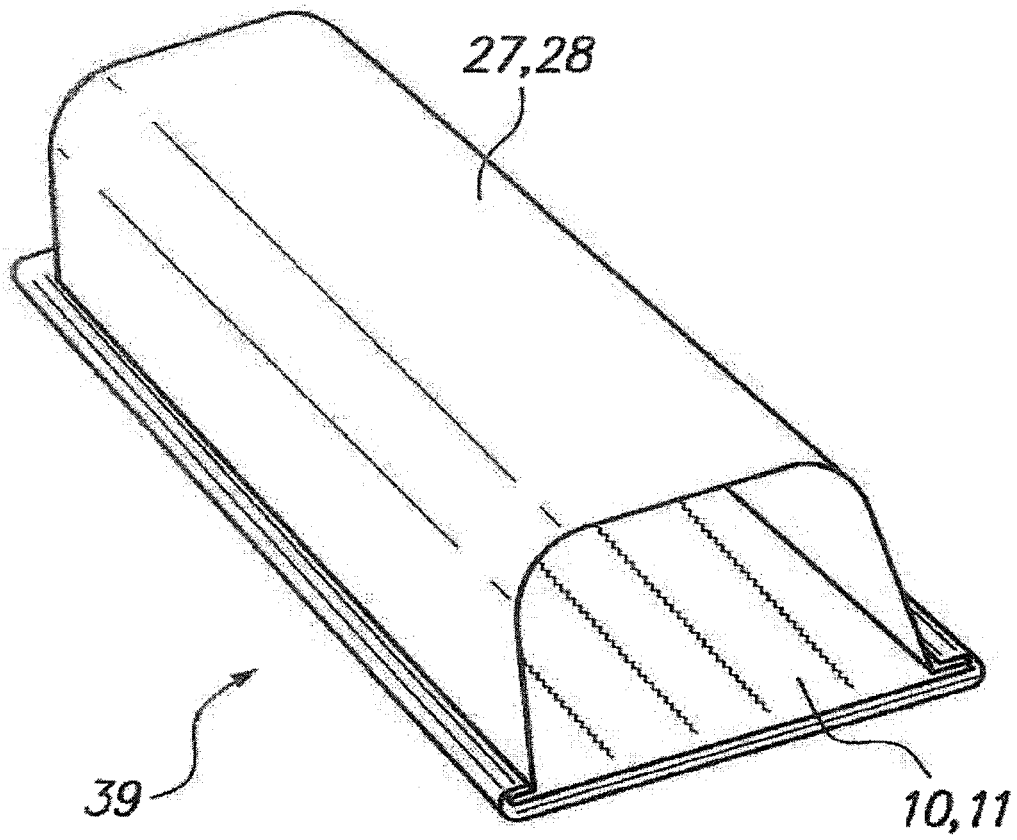
FIG. 16 is an exploded bottom plan view of FIG. 9 thereof of the pocket attached to the base panel, along showing the base hem and edging.

As shown in FIGS. 14-16, each pocket 27, 28 essentially holds or otherwise houses the weight members 8, 9, and further includes at least one pocket flap 35-38 for keeping the weight member 8, 9 inside the pocket. The bottom side of each pocket is permanently attached to the bottom side of each respective base panel 10, 11. Preferably, each pocket is sewn onto the respective base panel 10, 11. Each pocket comprises a single layer of fabric, similar to that of the base panel 10, 11. The lateral ends and the rear of the pocket are sewn onto the base panel 10, 11. The pocket has a depth large enough to accommodate different size weight members. The pocket size and shape may vary depending on the type of harness selected and depending on the size and mass of the selected weight members. The front end of the pocket is open and further includes a movable flap that can be closed and secured once the weight member has been inserted.

Each pocket includes a double layer fabric top flap 35, 37 and overlapping bottom flap 36, 38 which is positioned at the juncture where the open end of the pocket meets the base panel 10, 11. The top or interior flap includes the male Velcro (or hook and loop portions), and is connected to the top of the pocket and is hingedly attached near the top edge of the pocket. The bottom or outer flap having the female Velcro (or hook and loop portions) is hingedly attached near the bottom edge of the pocket near the base panel 10, 11 and lifted upwardly. When in the closed position, these flaps mate and retain the weight member 8, 9 inside the pocket. In one embodiment, the flap is also made from fabric, and is trimmed, folded and hemmed so that the ends are squared to the sides and top. The open end is hemmed for a clean edge. An inner Velcro-lined (hook and loop) pocket flap attaches near the outer lower (or upper) end of the pocket. The lateral edges of the pocket can be included in the hem when the base panel lateral hems are sewn.

The adjustable neck strap 26 helps maintain the position of the weighted shoulder strap members 4, 5 while the harness 1 is worn during physical activity. The neck strap 26 also prevents the shoulder strap members from shifting, swaying, dislodging or slipping from position. As shown in FIGS. 1-3 and 5-14, the neck strap 26 comprises an adjustable strap member 26 connected to a connector member 25B. One connector member 25A is attached to the strap 26 which extends from the inner side of the opposite shoulder member. The quick-release connectors or connecting members may be selected from the group consisting of quick-release connectors, strap and belt combination, buckles, a loop and strap combination, a strap and strap combination, and combinations thereof. Quick-release connectors are preferred.

In one embodiment, the neck strap is approximately 10 inches long and ¾ inch wide. It is permanently attached approximately 12 inches from the front on the inside edge of the right base. Connected to the adjustable end of the strap is the male portion of a quick-release connector. The female portion of the corresponding quick-release connector is permanently attached with a small fabric loop on the inside edge of the left base. Once the user adjusts the neck strap to a desired length, the user tightens (or knots) the connector by tying it off with the unused portion of the remaining strap.

Figure 9:
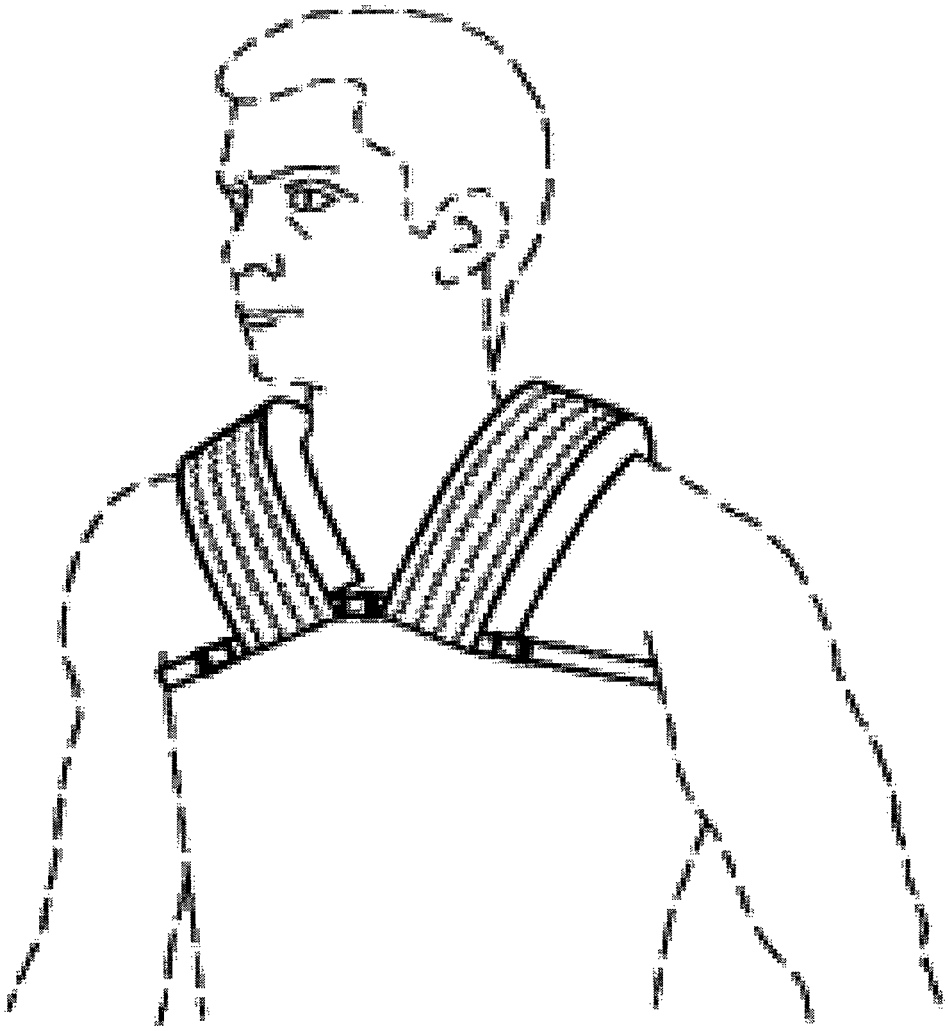
FIG. 9 is a front perspective view of an alternative embodiment of the soft shoulder weight device.
Figure 10:
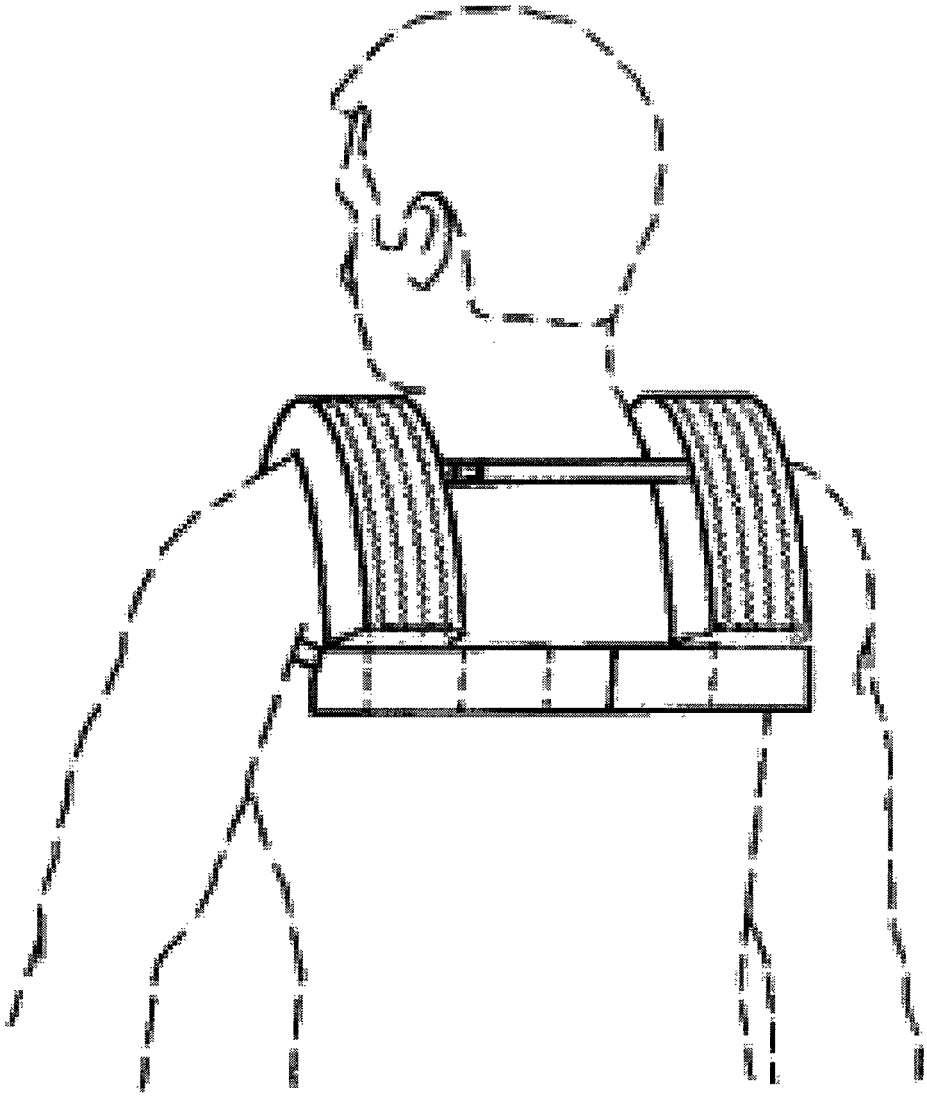
FIG. 10 is a rear perspective view of FIG. 9 thereof.
Figure 11:
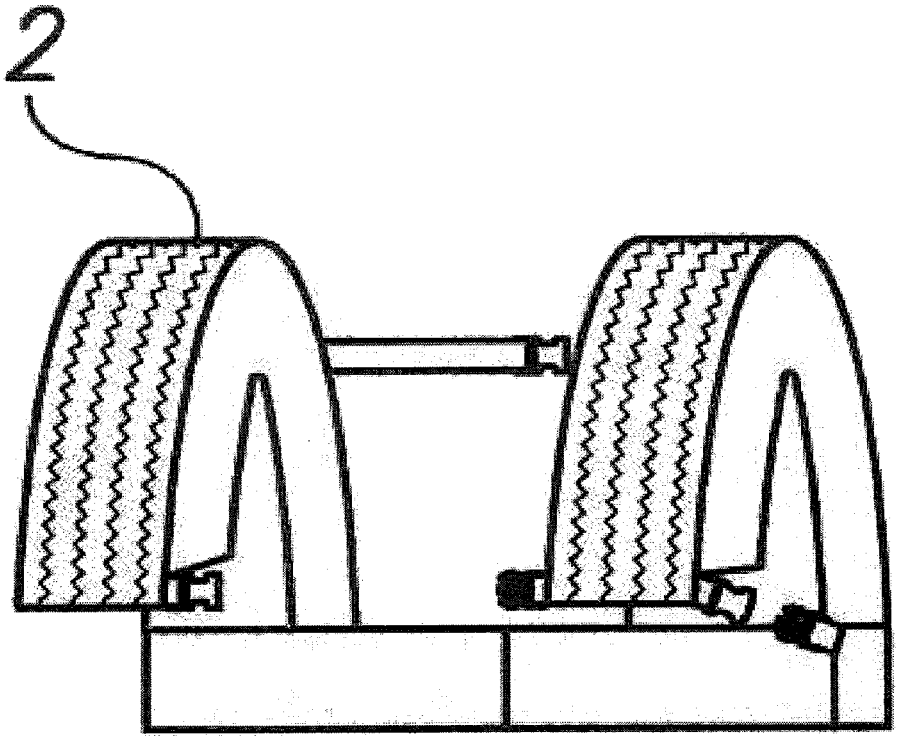
FIG. 11 is a front isomeric view of FIG. 9 thereof, with the chest strap and neck strap connectors shown in an open position.
Figure 12:
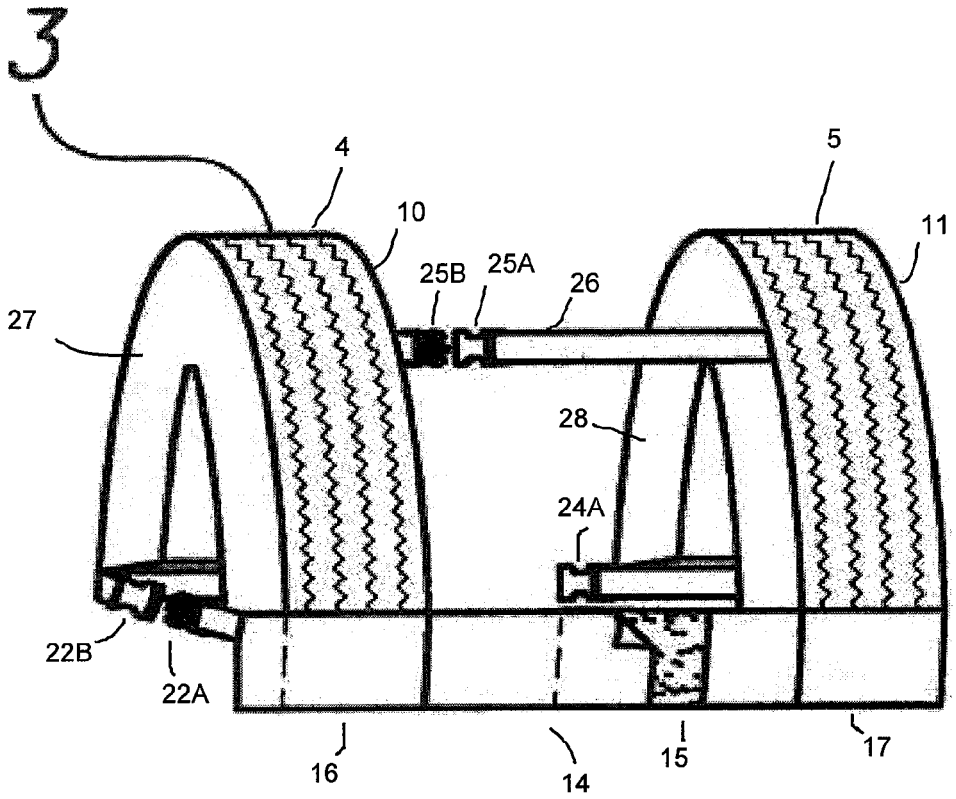
FIG. 12 is a rear isomeric view of FIG. 9 thereof, with all connectors shown in an open position.

Four connection points along the harness 1 prevent it from shifting, swaying, dislodging or slipping out of place on the body. The connection points include four sets of quick-release connectors 22A, 22B, 23A, 23B, 24A, 24B, 25A, 25B, and are located at the neck strap 26, the chest strap 24A, 24B, and the two underarm straps 6, 7. The first and second connection points 22A and 22B, and 23A and 23B, connect the underarm straps 6, 7 (and back of the horizontal base strap) to the front outer corner of the shoulder straps 4, 5, near the arm pits. The third connection point connects the neck strap connecting members 25A and 25B. The fourth connection point 24A and 24B connects the two shoulder strap members 4, 5 at the front of the harness 1, near the chest or neck area of the body. In one embodiment, the connected shoulder straps 4, 5 flex to form a V-shape at the connection point when in a closed position, as shown in FIGS. 8 and 9.

Figure 13:
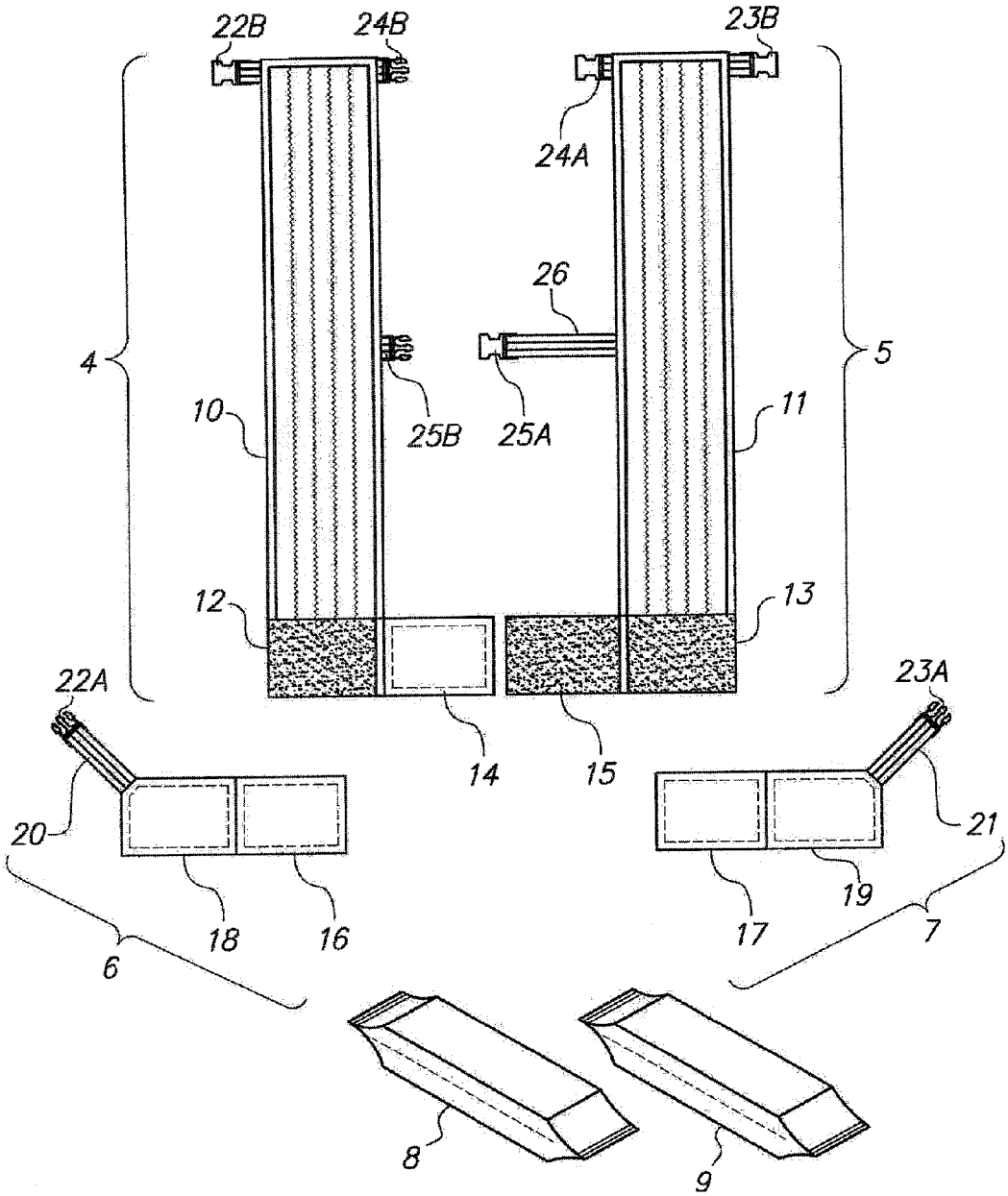
FIG. 13 is a top plan view of FIG. 9 thereof, with the components disassembled for clarity.

As shown in FIG. 13, the two underarm straps 6, 7 are essentially mirror images of each other. Each underarm strap 6, 7 comprises a double layer of fabric, a strap-length extender 20, 21 having a stretchable material 20, 21 and a quick-release connector 22A, 23A. A portion of each underarm strap 6, 7 attaches to the base 10, 11 with an attachment means or other removable adhesive. This strap-to-base attachment 16, 17 allows the user to adjust the fit of the underarm straps 6, 7 to accommodate varying chest thickness. The attachment means or adhering portion may be selected from the group consisting of hooks and loops, buttons, snaps, zippers, hooks, straps and buckles, and combinations thereof. The stretchable material 20, 21 is permanently attached near the end of the strap-length extender 18, 19. An elastic member is preferred for the stretchable material. The underarm straps 6, 7 may be widened to change or add to the front fastening mechanism. Alternatively, the underarm straps 6, 7 may be permanently attached to the base 10, 11 rather than being removably adjustable. The stretchable material 20, 21 would be the only way to adjust to the different body sizes, in addition to being a securing mechanism. The strap-length extender 18, 19 rests against the body and supports the stretchable material 20, 21 and connecting member 22A, 23A.

In one embodiment as shown in FIG. 13, the strap-to-base attachment members 16, 17 comprises a hook and loop. The inside portion of the strap-to-back attachment member contains the female hook and loop portion that is mated with the male portion on the outer portion of the base 10, 11, preferably the base-to-strap attachment member. Velcro® is the preferred hook and loop attachment. The stretchable material 20, 21 is attached at an approximate forty (40) degree angle for a straight pull. The stretchable material has multiple layers of fabric and is approximately four (4) inches long and ¾ inches wide. The end of the stretchable material is looped through the male portion of a quick-release connector. This aids in securing the device to the body.

A plurality of weight members 8, 9 are provided, and are available in a variety of masses. The different masses allow the user to customize the selected mass and bulk of the weight member 8, 9 used. A weight member 8, 9 may be inserted into each pocket during assembly of the device. Each weight member 8, 9 comprises a soft, pliable weighted substance enclosed within a membrane. The weighted substance is selected from the group consisting of un-solidified cement powder, sand, gravel, steal, lead shot and combinations thereof. A weighted substance substantially comprising unsolidified cement power is preferred. The weighted substance may be vacuum sealed in a non-permeable membrane to prevent ballooning and leakage of the substance. Alternatively, the substance may be enclosed in a breathable membrane with the membrane having a porosity rating that prevents leakage of the substance. The ends of the membrane may be heat-sealed. Preferably, each membrane-encased weight member 8, 9 has a tubular or oblong configuration.

The mass of each weight member 8, 9 may be selectively interchanged based on the user's preference, body size, and fitness level. The weight members 8, 9 may weigh approximately from five (5) to sixty (60) pounds. The user may select two weight members, one for each shoulder strap. Each weight member 8, 9 may have the same or a different mass from the other weight member 8, 9. For example, the left shoulder pocket may contain a ten (10) pound weight member while the right shoulder pocket may contain a thirty (30) pound weight member. The weight range may be 5-15 pounds, 18-28 pounds, 30-40 pounds, and 42-60 pounds.

The weights allow the user to perform a variety of physical fitness and therapy routines and activities ranging from sedate activities to more vigorous or robust activities. Each weight member 8, 9 is inserted into the respective shoulder pocket and secured to the device. In the embodiment, wherein the weight members 8, 9 are removable, each weight member 8, 9 may be changed in a short amount of time to avoid major interruption during the physical activity. Alternatively, the device may have a predetermined weight member that is permanently affixed to the device. Here, the device is ready to wear, except for adjusting the device on the body. Gravity is used to insert the weight members 8, 9 their full length. The device may be adjusted over the shoulders for comfort and to adjust the loose weighted aggregate of the weight member. In a preferred embodiment, the weight member is a soft, pliable weight member having a tubular or oblong configuration that is filled with un-solidified cement power. Alternative embodiments are anticipated. For example, the device may include a unitary harness wherein it only includes the adjustable neck strap and chest connectors. Alternatively, only the horizontal base-to-base attachment members (or sections) are permanently attached to the shoulder straps. The weights may be permanently attached to the shoulder straps, with the user selecting a particular harness based upon the total harness weight. In this embodiment, the base-to-base strap 14, 15 and strap-to-base attachment members 12, 16 and 13, 17 are not removable, with the device having a unitary harness.

To use the soft shoulder weight device (FIGS. 1, 9-10), the user inserts two weight members into the respective pockets and closes both pocket flaps. The harness is draped (or positioned) over the user's shoulders, the chest strap connectors are fastened, and the underarm straps are stretched about the body until the respective underarm connectors 22A, 23A are fastened to the outer connectors 22B, 23B, respectively, near the front of the shoulder straps.

Those skilled in the art who have the benefit of this disclosure will appreciate that it may be used as the creative basis for designing devices or methods similar to those disclosed herein, or to design improvements to the invention disclosed herein; such new or improved creations should be recognized as dependent upon the invention disclosed herein, to the extent of such reliance upon this disclosure.

I claim:

1. A soft shoulder weight device comprising:

a. two shoulder straps, with each of said shoulder straps comprising a base having a top surface; a plurality of quick-release connecting members; a horizontal back strap positioned below and between each of said shoulder straps, with said back strap having two overlapping ends; and a pocket attached along the length of said base of each said shoulder strap;

b. a chest strap comprising a first set of the plurality of said quick-release connecting members for connecting each of said shoulder straps together near the front of the user's body, and a second set of the plurality of said quick-release connecting members;

c. two adjustable underarm side straps, with each of said underarm straps comprising an underarm strap-to-back attachment member for attaching said underarm strap to said back strap; a strap-length extender for extending the length of each said underarm strap around the user's body, and a third set of the plurality of said quick-release connecting members for connecting an end of each said strap-length extender to the second set of said quick-release connecting members of said chest strap;

d. an adjustable neck strap having a strap and a fourth set of the plurality of said quick-release connecting members for connecting each of said shoulder straps together behind the user's neck for maintaining the position of said shoulder straps on the shoulders; and e. a plurality of weight members, each of said weight members being selectively interchangeable and insertable into each of said pockets.

2. The soft shoulder weight device of claim 1, said pocket comprising an opening at an end of said pocket and at least one flap connected along one edge of the pocket for opening and closing said pocket, each of said weight members removably insertable into said pocket and secured with said flap.

3. The soft shoulder weight device of claim 1, each of said weight members having a predetermined mass, each of said weight members selectively enclosed within said pocket for varying the intensity of the physical activity exerted upon the user.

4. The soft shoulder device of claim 3, each of said weight members having a mass ranging from approximately five pounds to sixty pounds.

5. The soft shoulder device of claim 1, each of said weight members having a pliable weighted substance in a sealed non-permeable membrane or a sealed semi-permeable membrane having low porosity, said weighted substance being selected from the group consisting of un-solidified cement powder, sand, gravel, lead shot and combinations thereof.

6. The soft shoulder weight device of claim 5, each of said weight members comprising un-solidified cement powder sealed in a non-permeable membrane for preventing leakage of said weighted substance.

7. The soft shoulder weight device of claim 1, said back strap further comprising a removably adjustable base-to-base strap having an adhesive surface, with a first base-to-base strap of one of said shoulder straps overlapping a second base-to-base strap of another of said shoulder straps, and a base-to-strap attachment member having an adhesive surface for overlapping and connecting with said strap-to-back attachment member, said strap-to-back attachment member having a corresponding adhesive surface.

8. A soft shoulder weight device for use during vigorous or robust physical activity, said soft shoulder weight device comprising:

a. a left shoulder strap and a right shoulder strap, each of said shoulder straps having an elongated base panel for positioning over the shoulder, each said base panel having a pocket affixed to said base panel, each said pocket having two flaps;

b. a horizontal back strap having a first section and a second section, said back strap for abutting against the user's back and positioned below each of said shoulder straps, with the first section of said back strap having a top surface comprising a first adhering portion and a second non-adhering portion, and a bottom surface comprising a third non-adhering portion and a fourth adhering portion; and with the second section of said back strap having a top surface comprising a fifth adhering portion, with said fourth adhering portion adjustably overlapping said fifth adhering portion to form said horizontal back strap;

c. a chest strap comprising a first set of quick-release connecting members for connecting said shoulder straps together near the front of the user's body, and a second set of quick-release connecting members;

d. two underarm straps, with a first of said underarm straps having an adhering bottom surface for adjustably attaching to said first adhering portion of said back strap and the second of said underarm straps having an adhering bottom surface for adjustably attaching to said fifth adhering portion of said back strap, each of said underarm straps further having a strap extender having a stretchable material for securing the device tightly around the user's body, and a third set of connecting members for connecting with said second set of connecting members of said chest strap;

e. an adjustable neck strap having a fourth set of quick-release connecting members having a mating end attached to each of said shoulder straps for connecting said shoulder straps together behind the user's upper body; and f. a first weight member and a second weight member selected from a plurality of interchangeable weight members, each of said weight members having a mass ranging from approximately five to sixty pounds, with said first weight member insertable into said pocket of said left shoulder strap and said second weight member insertable into said pocket of said right shoulder strap.

9. The soft shoulder weight device of claim 8, each of the sets of said quick-release connecting members being selected from the group consisting of quick-release connectors, strap and belt combination, buckles, a loop and strap combination, a strap and strap combination, and combinations thereof.

10. The soft shoulder weight device of claim 8, each of the plurality of said weight members having a predetermined mass, each of said weight members selectively enclosed within one of said pockets.

11. The soft shoulder device of claim 8, each of the plurality of said weight members independently having a mass from approximately five pounds to sixty pounds.

12. The soft shoulder device of claim 8, each of the plurality of said weight members having a pliable weighted substance sealed in a non-permeable membrane or sealed semi-permeable membrane having low porosity, said weighted substance being selected from the group consisting of un-solidified cement powder, sand, gravel, steal, lead shot and combinations thereof.

13. The soft shoulder weight device of claim 8, each of the plurality of said weight members comprising un-solidified cement powder sealed in a non-permeable membrane for preventing leakage of said weighted substance.

14. The soft shoulder weight device of claim 8, each of said adhering portions being selected from the group consisting of hooks and loops, buttons, snaps, zippers, hooks, straps and buckles, and combinations thereof.

15. The soft shoulder weight device of claim 8, said device further comprising each of said base panels of the left shoulder strap and right shoulder strap being approximately 17 inches long, 3 inches wide and having a ½ inch double thick hem around the perimeter of said base panel; each of said horizontal back straps being approximately 9 inches long and 2 inches wide; said neck strap being approximately 10 inches long and ¾ inches wide and attached approximately 12 inches from the front of each of said base panels; said underarm strap stretchable material being approximately 4 inches long and ¾ inches wide.

16. A soft shoulder weight device for use in vigorous or robust physical activity, said soft shoulder weight device comprising: a harness having:

a. two shoulder straps;

b. a chest strap having a first set of connecting members and a second set of connecting members, said first set of connecting members having two mating ends for detachably connecting the lower front ends of said shoulder straps together at the front of the user's body;

c. an adjustable neck strap having a third set of connecting members, said third set of connecting members having two mating ends for detachably connecting the shoulder straps together behind the user's neck for maintaining the position of said shoulder straps upon the shoulders;

d. an adjustable back strap having two strap-length extenders made from a stretchable material, with a first end of each of said strap-length extenders connecting together behind the user's back and an opposite end of each of said strap-length extenders extending around the user's underarms and body, the opposite end of each of said strap-length extenders having a fourth set of connecting members for connecting with the second set of connecting members of said chest strap;

e. a pocket attached along the length of each shoulder strap; and f. a plurality of weight members, each of said weight members having a predetermined mass for being selectively interchangeable and insertable into each of said pockets.

17. The soft shoulder weight device of claim 16, each of the plurality of said weight members having a predetermined mass ranging from approximately five pounds to sixty pounds for varying the intensity of the physical activity exerted upon the user.

18. The soft shoulder weight device of claim 16, each of the plurality of said weight members comprising un-solidified cement powder sealed in a non-permeable or a semi-permeable membrane having low porosity for preventing leakage of said weighted substance.

19. The soft shoulder weight device of claim 16, each of said pockets further comprising at least one flap located near the rear end of the pocket for enclosing and securing one of the weight members within the pocket.

* * * * *